US009752246B2

(12) United States Patent
Hiraoka et al.

(10) Patent No.: US 9,752,246 B2
(45) Date of Patent: Sep. 5, 2017

(54) FILM FORMATION APPARATUS AND FILM FORMATION METHOD FORMING METAL FILM

(71) Applicant: TOYOTA JIDOSHA KABUSHIKI KAISHA, Toyota-shi, Aichi (JP)

(72) Inventors: Motoki Hiraoka, Toyota (JP); Hiroshi Yanagimoto, Miyoshi (JP); Yuki Sato, Nagakute (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 0 days.

(21) Appl. No.: 15/033,967

(22) PCT Filed: Nov. 12, 2014

(86) PCT No.: PCT/JP2014/079953
§ 371 (c)(1),
(2) Date: May 3, 2016

(87) PCT Pub. No.: WO2015/072481
PCT Pub. Date: May 21, 2015

(65) Prior Publication Data

US 2016/0265129 A1 Sep. 15, 2016

(30) Foreign Application Priority Data

Nov. 14, 2013 (JP) ..... 2013-235552

(51) Int. Cl.
*C25D 5/06* (2006.01)
*C25D 17/14* (2006.01)
(Continued)

(52) U.S. Cl.
CPC ..... *C25D 5/06* (2013.01); *C25D 17/00* (2013.01); *C25D 17/005* (2013.01); *C25D 17/14* (2013.01); *C25D 3/00* (2013.01); *C25D 17/002* (2013.01)

(58) Field of Classification Search
CPC ..... C25D 5/06; C25D 17/14
See application file for complete search history.

(56) References Cited

U.S. PATENT DOCUMENTS 4,326,930 A * 4/1982 Nagel ..... C25B 9/10 205/161
6,277,261 B1 * 8/2001 Divisek ..... C25B 9/10 205/114
(Continued)

FOREIGN PATENT DOCUMENTS

JP 07216585 A 8/1995
JP 2012-219362 A 11/2012
(Continued)

*Primary Examiner* — Bryan D. Ripa
(74) *Attorney, Agent, or Firm* — Sughrue Mion, PLLC

(57) ABSTRACT

Provided is film formation apparatus of a metal film and a film formation method therefor capable of forming a homogeneous metal film of a uniform thickness stably, while being less affected by the surface state of the anode. A film formation apparatus 1A includes: an anode 11; a solid electrolyte membrane 13 disposed between the anode 11 and a base B serving as a cathode; and a power supply unit 14 to apply voltage between the anode 11 and the base B, the film formation apparatus being configured so that, when the solid electrolyte membrane 13 is brought into contact with a surface of the base B, and voltage is applied between the anode 11 and the base B, metal is deposited on the surface of the base B from metal ions included inside of the solid electrolyte membrane 13, so that the metal film F made of the metal is formed. The film formation apparatus 1A includes a mounting base 21 on which the base B is to be
(Continued)

placed, and the mounting base 21 has a suction unit 22 to suck the solid electrolyte membrane 13 from a side of the base B so that the solid electrolyte membrane 13 is brought into intimate contact with the surface of the base B during formation of the metal film F.

16 Claims, 6 Drawing Sheets

(51) Int. Cl.
*C25D 17/00* (2006.01)
*C25D 3/00* (2006.01)

(56) References Cited

U.S. PATENT DOCUMENTS

| | | | | |
|---|---|---|---|---|
| 6,610,190 | B2 * | 8/2003 | Basol | C25D 5/02 204/224 R |
| 9,115,438 | B2 * | 8/2015 | Simon | C25D 3/02 |
| 2014/0224662 | A1 * | 8/2014 | Arumugam | C25D 5/06 205/93 |
| 2015/0014178 | A1 | 1/2015 | Hiraoka et al. | |
| 2015/0329982 | A1 * | 11/2015 | Miura | C25D 7/0607 205/98 |

FOREIGN PATENT DOCUMENTS

| | | | | |
|---|---|---|---|---|
| JP | 2012219362 | A * | 11/2012 | C25D 17/00 |
| WO | 2013/125643 | A1 | 8/2013 | |

* cited by examiner (a)

(b)

(a)

(b)

(a)

(b)

(a)

(b)

FILM FORMATION APPARATUS AND FILM FORMATION METHOD FORMING METAL FILM

CROSS REFERENCE TO RELATED APPLICATIONS

This is a National Stage of International Application No. PCT/JP2014/079953 filed Nov. 12, 2014, claiming priority based on Japanese Patent Application No. 2013-235552 filed Nov. 14, 2013, the contents of all of which are incorporated herein by reference in their entirety.

TECHNICAL FIELD

The present invention relates to a film formation apparatus and a film formation method for forming a metal film capable of forming a metal film favorably by applying voltage between an anode and a base so as to deposit metal on a surface of the base out of metal ions included inside of a solid electrolyte membrane.

BACKGROUND ART

Conventionally, when an electronic circuit board or the like is to be produced, a nickel film is formed on the surface of a base to form a nickel circuit pattern thereon. For example, in order to form such a metal film, some film formation techniques have been proposed, forming a metal film on the surface of a semiconductor substrate made of Si or the like by plating processing such as electroless plating processing, or forming a metal film by PVD, such as sputtering.

When plating processing such as electroless plating processing is performed, however, this requires washing with water after the plating processing, as well as disposing of a waste liquid after the washing. When a film is formed on the surface of a base by PVD such as sputtering, internal stress is generated in the metal film formed, and so there is a limit in increasing the thickness of the film. In particular, in the case of sputtering, a film may be formed only in a high vacuum in some cases.

In view of the foregoing, a film formation apparatus 9 of a metal film has been proposed, for example, as shown in FIG. 6(*a*), including an anode 91, a base B serving as a cathode, a solid electrolyte membrane 93 disposed between the anode 91 and the base (cathode) B, and a power supply unit 94 that applies voltage between the anode 91 and the base B (see Patent Literature 1, for example).

The anode 91 of the film formation apparatus 9 as stated above is a porous body letting metal ions pass therethrough. Since the anode 91 is such a porous body, solution L including metal ions is allowed to pass through the anode 91 during film formation so as to always supply the metal ions to the solid electrolyte membrane 93. Further, the film formation apparatus 9 includes a pressure unit 96 to press the solid electrolyte membrane 93 against the base B via the anode 91. In this way, a metal film made of metal deposited via the solid electrolyte membrane 93 can be formed on the surface of the base B placed on a mounting base 92.

CITATION LIST

Patent Literature

Patent Literature 1: WO 2013-125643

SUMMARY OF INVENTION

Technical Problem

When the film formation apparatus as shown in Patent Literature 1 is used, however, voltage is applied between the anode 91 and the base (cathode) B while pressing the solid electrolyte membrane 93 with the anode 91 as a porous body to form a metal film F on the surface of the base B as shown in FIG. 6(*b*). Then pinholes are formed in the metal film F or the thickness of the film is fluctuated (unevenness in film) (see FIG. 7(*a*)) in some cases.

This results from a non-uniform pressure state generated between a skeleton part 91*a* and holes 91*b* of the anode 91 as a porous body because the solid electrolyte membrane 93 is pressed with the anode 91 during film formation. Therefore metal deposition depends on the surface state of the porous body that is the anode 91, so that the surface shape of the anode 91 is transferred to the metal film F.

Further, since initial deposition of metal occurs at a position of the holes 91*b* of the anode 91 that is pressed, such deposited metal acts as a core and metallic crystal will grow in the thickness direction of the metal film F. Thereby, the metallic crystal does not extend in the in-plane direction of the metal film F, but it becomes a columnar crystal grown in the thickness direction as shown in FIG. 7(*b*), which becomes a factor for unevenness in film formed. Such a phenomenon is noticeable when a porous body is used, and may occur when the anode has fine irregularity at the surface as well.

In view of the foregoing, the present invention aims to provide a film formation apparatus and a film formation method for forming a metal film capable of forming a homogeneous metal film having a uniform film thickness stably, irrespective of the surface state of the anode.

Solution to Problem

As a result of a further study, the present inventors think that, when an anode is pressed to a solid electrolyte membrane excessively so as to let the solid electrolyte membrane follow the surface of the base, the surface state of the anode affects the metal film formed. Then, the present inventors came up with the idea that pressure from the anode to the solid electrolyte membrane as stated above can be eliminated or reduced by sucking the solid electrolyte membrane from the side of the base so as to let the solid electrolyte membrane follow the surface of the base.

The present invention is based on such an idea, and a film formation apparatus of a metal film according to the present invention includes: an anode; a solid electrolyte membrane disposed between the anode and a base serving as a cathode; and a power supply unit to apply voltage between the anode and the base. The film formation apparatus is configured so that, when the solid electrolyte membrane is brought into contact with a surface of the base, and voltage is applied between the anode and the base, metal is deposited on the surface of the base from metal ions included inside of the solid electrolyte membrane, so that the metal film made of the metal is formed. The film formation apparatus includes: a mounting base on which the base is to be placed, and a suction unit to suck the solid electrolyte membrane from a side of the base so that the solid electrolyte membrane is brought into intimate contact with the surface of the base placed on the mounting base during formation of the metal film.

According to the present invention, the solid electrolyte membrane can be sucked from a side of the base so that the solid electrolyte membrane is brought into intimate contact with the surface of the base during formation of the metal film. Thereby, the solid electrolyte membrane sucked by the suction unit can be pressed to the surface of the base uniformly without directly pressing the solid electrolyte membrane with the anode (or with reducing the degree of pressing than before). As a result, non-uniform pressure generated between the solid electrolyte membrane and the anode and resulting from the surface state of the anode can be eliminated or can be reduced, and a homogeneous metal film of a uniform thickness can be formed stably, while being less affected by the surface state of the anode.

Further, since the solid electrolyte membrane is sucked from the side of the base during film formation, the solid electrolyte membrane can be pressed so as to follow the surface of the base having the shape, such as a surface shape having irregularities or a curved-face shape, as well. In this way, a homogeneous metal film of a uniform thickness can be formed on a surface of the base having such a shape as well.

Herein, as long as non-uniform pressure of the pressure between the anode and the solid electrolyte membrane can be reduced by suction of the solid electrolyte membrane, the solid electrolyte membrane and the anode may be in any state of a contact state and a non-contact state. In a preferable embodiment, a solution containing part is defined between the anode and the solid electrolyte membrane so as to store solution including the metal ions so that the solution including the metal ions comes into contact with the anode and the solid electrolyte membrane.

According to this embodiment, the solution containing part stores the solution including metal ions, and therefore the metal ions can be supplied always to the solid electrolyte membrane. Further the solution containing part provided enables the anode and the solid electrolyte membrane to be disposed away from each other (be in a non-contact state). Since the solid electrolyte membrane and the anode are in a non-contact state, the solid electrolyte membrane is not pressed by the anode during film formation, but the surface of the base is pressed by the solid electrolyte membrane due to suction of the suction unit. As a result, the metal film formed will be less affected from the surface state of the anode. When the anode is a porous body as well, since the anode and the solid electrolyte membrane are sufficiently separated, the metal film formed will less depend on the shape of pores of the porous body.

In a more preferable embodiment, the film formation apparatus further includes a circulation mechanism in the solution containing part to circulate the solution including the metal ions. According to this embodiment, the metal film can be formed while circulating the solution including metal ions stored between the anode and the solid electrolyte membrane by the circulation mechanism. Thereby, the metal film can be formed stably while controlling the concentration of the metal ions in the solution. In the configuration to let liquid pressure act on the solution including metal ions in the solution containing part to press the solid electrolyte membrane against the base, it may be difficult to include the circulation mechanism as stated above because constant liquid pressure has to be acted. According to the present invention, however, pressing of the solid electrolyte membrane against the base is performed by sucking the solid electrolyte membrane, whereby the circulation mechanism as stated above can be easily provided at the film formation apparatus.

The configuration of the suction unit as stated above is not limited especially as long as it can press the solid electrolyte membrane to the surface of the base uniformly. In a preferable embodiment, the suction unit includes a plurality of membrane suction ports at a surface of the mounting base so as to suck the solid electrolyte membrane, and the plurality of membrane suction ports is along periphery of the base placed on the mounting base. According to this embodiment, suction is performed along the periphery of the base and negative pressure can be generated in the space around it. Thereby, the solid electrolyte membrane coming into contact with the periphery of the base can be sucked more effectively, and can be pressed to the surface of the base uniformly.

In a more preferable embodiment, the membrane suction ports are formed so that each membrane suction port is covered with the periphery of the base partially when the base is placed on the mounting base. According to this embodiment, a part of each membrane suction port that is not covered with the periphery of the base becomes adjacent to the periphery of the base, whereby a stronger suction power can act on the solid electrolyte membrane coming into contact with the vicinity of the periphery of the base. Thereby, the film formation region as a whole of the base can be pressed more uniformly.

The suction unit may include a base suction port at the surface of the mounting base to suck the base placed on the mounting base toward the mounting base, the base suction port may be formed toward a center part of a surface of the base opposed to the mounting base when the base is placed on the mounting base, and the suction unit further may include a membrane suction port opening/closing valve connected to the membrane suction ports so as to allow selection between suction and not-suction from the membrane suction ports, and a base suction port opening/closing valve connected to the base suction port so as to allow selection between suction and not-suction from the base suction port.

According to this embodiment, while placing the base in the mounting base, suction from the base suction port is selected by opening the base suction port opening/closing valve, so as to allow suction of the base from the base suction port to the mounting base at a center part of the surface of the base that is opposed to the mounting base. Subsequently, suction of the membrane suction ports is selected by opening the membrane suction port opening/closing valve, whereby the solid electrolyte membrane can be sucked to the base that is sucked to the mounting base from the membrane suction ports at the positions along the periphery of the base. In this way, air between the mounting base and the base can be discharged from the center part of the surface of the base facing the mounting base toward the periphery thereof. Thereby, accumulation of air between the mounting base and the base during film formation can be suppressed, so that the base can be sucked to the mounting base uniformly. As a result, the surface of the base on which a metal film is to be formed can follow the surface of the mounting base, and so the solid electrolyte membrane can be brought into contact with the base more uniformly.

In a more preferable embodiment, a plurality of the membrane suction port opening/closing valves are provided so as to allow the plurality of membrane suction ports to suck the solid electrolyte membrane at different timings. According to this embodiment, the solid electrolyte membrane can be sucked while changing timings to suck the solid electrolyte membrane at different positions along the periphery of the base. Thereby, the solid electrolyte membrane is not sucked at the entire periphery of the base at the same time, whereby remaining of air between the solid electrolyte membrane and the base can be suppressed, and air on the surface of the base can be discharged favorably.

The shape of the mounting base is not limited especially as long as it enables intimate contact of the solid electrolyte membrane with the surface of the base by the suction unit during film formation. In a preferable embodiment, the mounting base includes a storage recess to store the base when the metal film is formed on a surface of the base.

According to this embodiment, the mounting base includes a storage recess to store the base, whereby the surface of the mounting base and the surface of the base can be brought closer to each other in the height direction (preferably to be flush). As a result, negative pressure can be generated effectively by the suction unit between the solid electrolyte membrane and the base, and so they can be brought into intimate contact with each other.

The present application further discloses a film formation method capable of forming a metal film favorably. A film formation method of a metal film according to the present invention includes: disposing a solid electrolyte membrane between an anode and a base serving as a cathode; bringing the solid electrolyte membrane into contact with the base and applying voltage between the anode and the base, so as to deposit metal on a surface of the base from metal ions included inside of the solid electrolyte membrane, so that the metal film made of the metal is formed on the surface of the base. In this method, when the metal film is formed, the solid electrolyte membrane is sucked from a side of the base so that the solid electrolyte membrane is brought into intimate contact with the surface of the base.

According to the present invention, the solid electrolyte membrane and the anode are in a non-contact state, and when the metal film is formed, the solid electrolyte membrane is sucked from a side of the base so that the solid electrolyte membrane is brought into intimate contact with the surface of the base. Therefore the solid electrolyte membrane can be pressed to the surface of the base uniformly without directly pressing the solid electrolyte membrane with the anode (or with reducing the degree of pressing than before). As a result, a homogeneous metal film of a uniform thickness can be formed stably, while being less affected by the surface state of the anode.

Further, since the solid electrolyte membrane is sucked from the side of the base during film formation, the solid electrolyte membrane can be pressed so as to follow the surface of the base having a shape other than a flat face as well. In this way, a homogeneous metal film of a uniform thickness can be formed on the surface of the base.

Herein, as long as non-uniform pressure of the pressure between the anode and the solid electrolyte membrane can be reduced by suction of the solid electrolyte membrane, the solid electrolyte membrane and the anode may be in any state of a contact state and a non-contact state. In a preferable embodiment, the metal film is formed while storing solution including the metal ions between the anode and the solid electrolyte membrane so that the solution including the metal ions comes into contact with the anode and the solid electrolyte membrane.

According to this embodiment, since the solution including metal ions is stored between the anode and the solid electrolyte membrane, the metal ions can be supplied always to the solid electrolyte membrane. Further since the solution including metal ions is stored, the anode and the solid electrolyte membrane can be disposed away from each other (be in a non-contact state). Since the solid electrolyte membrane and the anode are in a non-contact state, the solid electrolyte membrane is not pressed by the anode during film formation, but the surface of the base is pressed by the solid electrolyte membrane due to suction of the suction unit. As a result, the metal film formed will be less affected from the surface state of the anode.

In a more preferable embodiment, the metal film is formed while circulating the solution including the metal ions stored between the anode and the solid electrolyte membrane. According to this embodiment, since the metal film is formed while circulating the solution including metal ions stored between the anode and the solid electrolyte membrane, the metal film can be formed stably while controlling the concentration of the metal ions in the solution.

In a more preferable embodiment, the solid electrolyte membrane is sucked from a position along periphery of the base. This allows negative pressure to be generated along the periphery of the base, whereby the solid electrolyte membrane in contact with the periphery of the base can be sucked more effectively, and this can be pressed to the surface of the base uniformly.

In a more preferable embodiment, in the film formation method, the metal film is formed while placing the base on a mounting base, and along with suction of the solid electrolyte membrane, the periphery of the base is sucked toward the mounting base. This allows a stronger suction power to act on the solid electrolyte membrane coming into contact with the vicinity of the periphery of the base. Thereby, the film formation region as a whole of the base can be pressed uniformly.

In a more preferable embodiment, in the film formation method, the base placed on the mounting base is sucked toward the mounting base at a center part of a surface of the base opposed to the mounting base, and the solid electrolyte membrane is sucked to the base that is sucked to the mounting base. According to this embodiment, the suction as stated above is performed successively, whereby air between the mounting base and the base can be discharged from the center part of the surface of the base facing the mounting base toward the periphery thereof. Thereby, accumulation of air between the mounting base and the base during film formation can be suppressed, so that the base can be sucked to the mounting base uniformly. As a result, the surface of the base on which a metal film is to be formed can follow the surface of the mounting base, and so the solid electrolyte membrane can be brought into contact with the base more uniformly.

In a more preferable embodiment, the solid electrolyte membrane is sucked at different positions along the periphery of the base while changing timings to suck the solid electrolyte membrane. According to this embodiment, the solid electrolyte membrane is not sucked at the entire periphery of the base at the same time, whereby remaining of air between the solid electrolyte membrane and the base can be suppressed, and air on the surface of the base can be discharged favorably.

In a more preferable embodiment, the mounting base includes a storage recess to store the base, and the metal film is formed on a surface of the base that is stored in the storage recess. As a result, negative pressure can be generated effectively by the suction unit between the solid electrolyte membrane and the base, and so they can be brought into intimate contact with each other.

Advantageous Effects of Invention

According to the present invention, a homogeneous metal film of a uniform thickness can be formed stably, while being less affected by the surface state of the anode.

DESCRIPTION OF EMBODIMENTS

The following describes a film formation apparatus capable of implementing a metal film formation method according to one embodiment of the present invention favorably.

[Embodiment 1]

Figure 1:
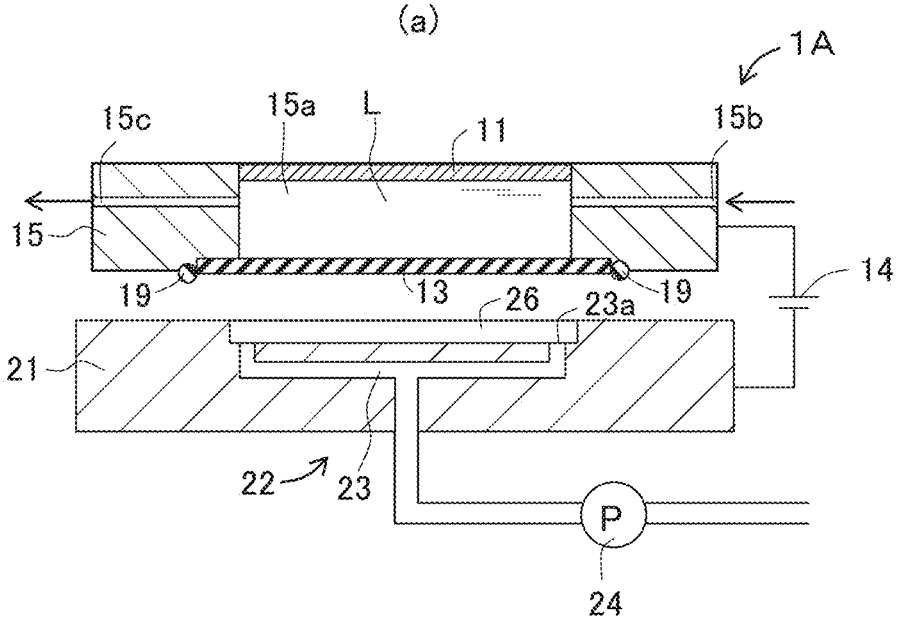
FIG. 1 is a schematic conceptual view of a film formation apparatus for forming a metal film in accordance with Embodiment 1 of the present invention, in which (a) is a schematic cross sectional view to describe the state of the film formation apparatus before film formation, and (b) is a schematic cross sectional view to describe the state during film formation of the film formation apparatus.
Figure 1:
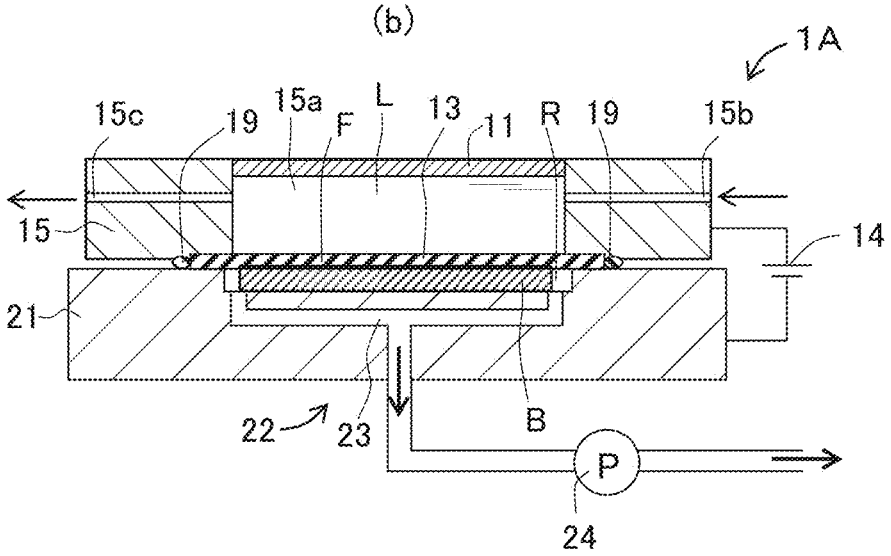

FIG. 1 is a schematic conceptual view of a film formation apparatus for forming a metal film in accordance with Embodiment 1 of the present invention, in which (a) is a schematic cross sectional view to describe the state of the film formation apparatus before film formation, and (b) is a schematic cross sectional view to describe the state during film formation of the film formation apparatus.

Figure 2:
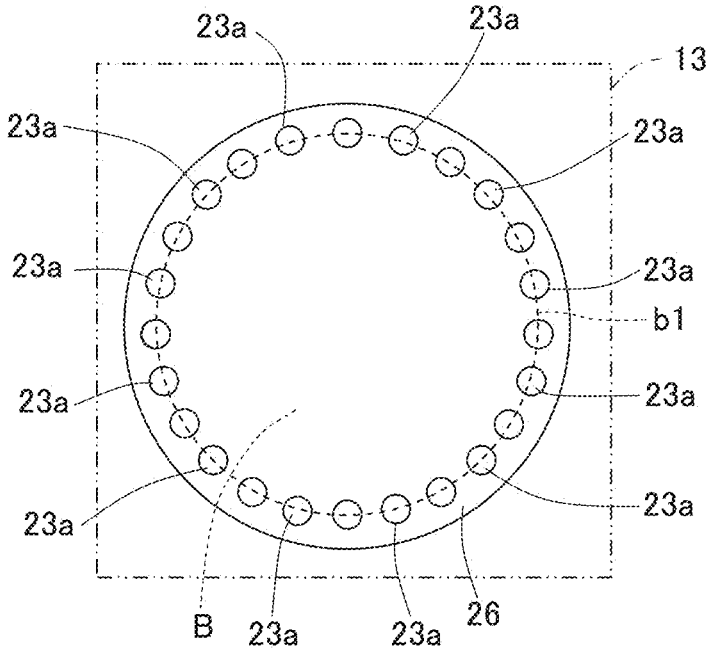
FIG. 2 is a plan view showing the positional relationship among a solid electrolyte membrane, a membrane suction port of a suction unit and a base in the film formation apparatus shown in FIG. 1.
Figure 3:
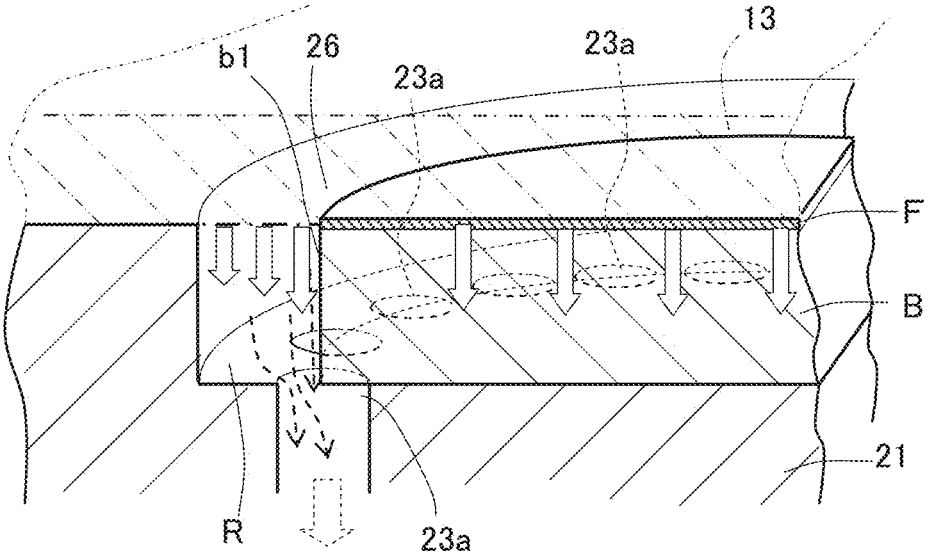
FIG. 3 is a schematic perspective cross-sectional view to describe the state around the membrane suction port of the film formation apparatus shown in FIG. 2 during film formation.

FIG. 2 is a plan view showing the positional relationship among a solid electrolyte membrane, a membrane suction port of a suction unit and the base in the film formation apparatus shown in FIG. 1. FIG. 3 is a schematic perspective cross-sectional view to describe the state around the membrane suction port of the film formation apparatus shown in FIG. 2 during film formation.

As shown in FIG. 1, a film formation apparatus 1A according to the present invention is an apparatus to deposit metal from metal ions and form a metal film made of the deposited metal on a surface of the base B. Herein the base B may be made of a metal material, such as aluminum, or may be made up of a resin or silicon base, on the processing surface of which a metal base layer is formed.

The film formation apparatus 1A at least includes an anode 11 made of metal, a solid electrolyte membrane 13 disposed between the anode 11 and the base B serving as a cathode, and a power supply unit 14 to apply voltage between the anode 11 and the base B. Although not illustrated in details in FIG. 1, the anode 11 and the base B serving as the cathode are electrically connected to the power supply unit 14.

The solid electrolyte membrane 13 and the anode 11 are disposed in a casing 15 so as to be kept away from each other, and the solid electrolyte membrane 13 and the anode 11 are in a non-contact state. A solution containing part 15*a* is defined between the solid electrolyte membrane 13 and the anode 11 so as to contain solution L including metal ions (hereinafter called metal solution). Herein, the solution containing part 15*a* is configured so as to bring the metal solution L contained into direct contact with the anode 11 and the solid electrolyte membrane 13. The casing 15 is made of a metal material that is insoluble in the metal solution L, and the anode 11 conducts to the positive electrode of the power supply unit 14 via the casing 15. The anode 11 may conduct to the positive electrode of the power supply unit 14 directly.

The anode 11 has a shape corresponding to the film formation region of the base B. Herein in order to deposit metal more effectively from metal ions during film formation, it is preferable that the decomposition reaction of water ($2H_2O \rightarrow O_2 + 2H^+ - 2e^-$) can be generated smoothly at the anode 11. That is, more progressed such a reaction at the anode will contribute greatly to the film formation rate of the metal film on the surface of the base B serving as the cathode.

Therefore as examples of a material of the anode 11 enabling such a reaction to progress smoothly and having electric conductivity enabling action as the anode, ruthenium oxide, platinum or titanium having an insoluble property in the metal solution or an anode having a soluble property that is made of metal in the metal solution are available. The anode 11 may be a porous body, and is a non-porous body more preferably. Such an anode 11 as a non-porous body makes the metal film F to be formed on the base B less susceptible to the surface state of the anode 11.

The metal solution L may be aqueous solution including ions such as copper, nickel, or silver, for example. For instance, in the case of nickel ions, the solution including nickel nitrate, nickel sulfate, nickel sulfamate or the like may be used. For the solid electrolyte membrane 13, a membrane or a film made of solid electrolyte, for example, may be used.

The solid electrolyte membrane 13 is not limited especially, as long as when it comes into contact with the metal solution L as stated above, the membrane can be impregnated with metal ions internally, and when voltage is applied, metal originating from the metal ions can be deposited on the surface of the base B. Examples of the material of the solid electrolyte membrane include fluorine-based resin such as Nafion (registered trademark) produced by DuPont, hydrocarbon-based resin, polyamic-acid resin, and resin having an ion exchanging function, such as Selemion (CMV, CMD, CMF series) produced by Asahi glass Co., Ltd.

In the present embodiment, the film formation apparatus 1A further has a circulation mechanism (not illustrated) in the solution containing part 15*a* to circulate the metal solution L. Such a circulation mechanism allows the metal solution L in which the concentration of metal ions is adjusted to predetermined concentration to be supplied to the solution containing part 15*a* through a supply port 15*b* and allows the metal solution L used for film formation in the solution containing part 15*a* to be discharged through a discharge port 15*c*. In the film formation 1A according to the present embodiment, or in the configuration to let liquid pressure act on the solution including metal ions in the solution containing part 15*a* to press the solid electrolyte membrane against the base, it may be difficult to include the circulation mechanism as stated above because constant liquid pressure has to be acted. In the present embodiment, however, pressing of the solid electrolyte membrane 13 against the base B is performed by sucking the solid electrolyte membrane 13 by a suction unit 22, whereby the circulation mechanism as stated above can be easily provided at the film formation apparatus.

The film formation apparatus 1A further includes a mounting base 21 on which the base B is placed, and the suction unit 22 to suck the solid electrolyte membrane 13 from the side of the base B (mounting base 21) so that the solid electrolyte membrane 13 is brought into intimate contact with the surface of the base B placed on the mounting base 21 when a metal film F is formed.

The suction unit 22 includes a membrane suction path 23 and a suction pump 24 connected to one end of the membrane suction path 23. Although the suction pump 24 is provided separately from the mounting base 21, this suction pump may be provided at the mounting base, and the suction pump and the membrane suction path may be configured as a suction unit collectively. Devices other than the suction pump may be used as long as the solid electrolyte membrane 13 can be sucked from the side of the base B via the membrane suction path 23.

As shown in FIG. 3, the mounting base 21 of the present embodiment further has a storage recess 26 to store the base B, and a plurality of membrane suction ports 23*a*, 23*a* . . . are formed at the bottom face of the storage recess 26 (the surface of the mounting base 21). The plurality of membrane suction ports 23*a*, 23*a* . . . are suction ports to suck the solid electrolyte membrane 13, which are formed at the other end of the membrane suction path 23 and makes up a part thereof. The membrane suction ports 23*a* are described later.

Herein the depth of the storage recess 26 is the same as the thickness of the base B. Thereby, when the base B is stored in the storage recess 26, the surface of the base B and the surface of the mounting base 21 are disposed like in a same plane. In this way, the solid electrolyte membrane 13 can be sucked by the suction unit 22 while blocking the opening of the storage recess 26 with the solid electrolyte membrane 13, whereby the solid electrolyte membrane 13 can press the base B with a stronger suction power.

As shown in FIGS. 2 and 3, in the present embodiment, the plurality of membrane suction ports 23*a*, 23*a* . . . are formed at regular intervals along the periphery b1 of the base B placed on the mounting base 21. Each membrane suction port 23*a* is formed so that, when the base B is disposed (placed) in the storage recess 26 of the mounting base 21, the periphery of the base B covers the membrane suction port 23*a* partially. Further, when the base B is stored in the storage recess 26, an annular groove R is defined between the storage recess 26 and the base B so as to surround the base B.

As shown in FIG. 3, when the base B is stored in the storage recess 26, the annular groove R is defined between the storage recess 26 and the base B so as to surround the base B, and air in the space of the annular groove R has negative pressure due to suction from the membrane suction ports 23*a*. Thereby, the solid electrolyte membrane 13 in contact with the periphery b1 of the base B can be sucked more effectively, and this can be pressed to the surface of the base B uniformly. Especially since suction of the solid electrolyte membrane 13 is performed while covering the membrane suction ports 23*a* with the periphery b1 of the base B partially, a strong suction power can act on the solid electrolyte membrane coming into contact with the periphery b1 of the base B.

Moreover, in the present embodiment, an O-ring 19 is disposed at the casing 15 so as to surround the solid electrolyte membrane 13. Thereby, the 0-ring 19 functions as a sealing member to define an enclosed space between the solid electrolyte membrane 13 and the mounting base 21 including the base B during film formation. As a result, since air in the enclosed space is sucked by the suction unit, the solid electrolyte membrane 13 can be pressed to (brought into intimate contact with) the surface of the base B effectively.

The following describes a film formation method according to the present embodiment. Firstly, the base B is placed in the storage recess 26 of the mounting base 21. Specifically as shown in FIG. 2, the membrane suction ports 23*a*, 23*a* . . . are disposed along the periphery b1 of the base B placed on the mounting base 21, and each of the membrane suction port 23*a* is blocked with the periphery b1 of the base B partially. With such an arrangement, the annular groove R is defined between the base B and the mounting base 21 so as to surround the periphery b1 of the base B.

In such arrangement, the casing 15 is placed above the base B, and the solid electrolyte membrane 13 is brought into contact with the base B. At this stage, the solid electrolyte membrane 13 and the base B do not have to come into contact necessarily if the solid electrolyte membrane 13 can be sucked the by suction unit 22 described later so as to bring the solid electrolyte membrane 13 into intimate contact with the surface of the base B. In such a state, the anode 11 and the base B as the cathode are electrically connected to the power supply unit 14.

Then, when a metal film F is formed (specifically before the film formation), the suction pump 24 is driven so as to bring the solid electrolyte membrane 13 into intimate contact with the surface of the base B, whereby the solid electrolyte membrane 13 is sucked from the side of the base at the plurality of membrane suction ports 23*a*, 23*a* . . . , and the periphery of the base B is sucked toward the mounting base. As shown in FIG. 3, air in the annular groove R covered (sealed) with the solid electrolyte membrane 13 is deaerated through the membrane suction ports 23*a* as indicated with broken arrows, so that the solid electrolyte membrane 13 is pressed to the surface of the base (brought into intimate contact).

As stated above, since the plurality of membrane suction ports 23*a* are arranged along the periphery b1 of the base B, and a part of each membrane suction port 23*a* that is not covered with the periphery b1 becomes adjacent to the periphery b1 of the base B, whereby a stronger suction power can act on the solid electrolyte membrane 13 coming into contact with the vicinity of the periphery of the base B.

Thereby, the film formation region as a whole of the base B can be pressed uniformly, and the solid electrolyte membrane 13 can follow the surface (film formation region) of the base B uniformly. Further, the groove R provided can avoid blocking of the membrane suction ports 23*a* during suction, so that while gas (hydrogen gas) generated as a by-product during film formation can be discharged from the membrane suction ports 23*a*, a metal film can be formed on the surface of the base B.

Next, voltage is applied between the anode 11 and the base B serving as the cathode using the power supply unit 14 while keeping the solid electrolyte membrane 13 into contact with the surface of the base B, so as to deposit metal on the surface of the base B from metal ions included inside of the solid electrolyte membrane 13, whereby a metal film F is formed on the surface of the base B. At this time, since the metal solution L is stored in the solution containing part 15*a*, metal ions can be always supplied to the solid electrolyte membrane 13.

The solution containing part 15*a* provided further enables the anode 11 and the solid electrolyte membrane 13 to be disposed away from each other. Since the solid electrolyte membrane and the anode are in a non-contact state, the solid electrolyte membrane 13 is not pressed by the anode 11 during film formation, but the surface of the base B is pressed by the solid electrolyte membrane 13 due to suction of the suction unit 22. As a result, the metal film formed will be less affected from the surface state of the anode. When the anode is a porous body as well, since the anode 11 and the solid electrolyte membrane 13 are sufficiently away, the metal film formed will less depend on the shape of pores of the porous body.

When the metal film F is to be formed continuously, the metal solution L stored between the anode 11 and the solid electrolyte membrane 13 is circulated by the circulation mechanism. Thereby, the metal film can be formed stably while controlling the concentration of metal ions in the solution. Further, since the metal solution L can be supplied as needed, the amount of metal that can be deposited is not limited, and a metal film F of a desired thickness can be formed on the surface of a plurality of bases B.

In this way, according to the present embodiment, when a metal film F is formed, the solid electrolyte membrane 13 can be sucked from the side of the base so that the solid electrolyte membrane 13 comes in intimate contact with the surface of the base B. Thereby, the solid electrolyte membrane 13 sucked by the suction unit 22 can be pressed to the surface of the base B uniformly without directly pressing the solid electrolyte membrane 13 with the anode 11 (or with reducing the degree of pressing than before). As a result, non-uniform pressure generated between the solid electrolyte membrane 13 and the anode 11 and resulting from the surface state of the anode 11 can be eliminated or can be reduced, and a homogeneous metal film F of a uniform thickness can be formed stably, while being less affected by the surface state of the anode 11.

[Embodiment 2]

Figure 4:
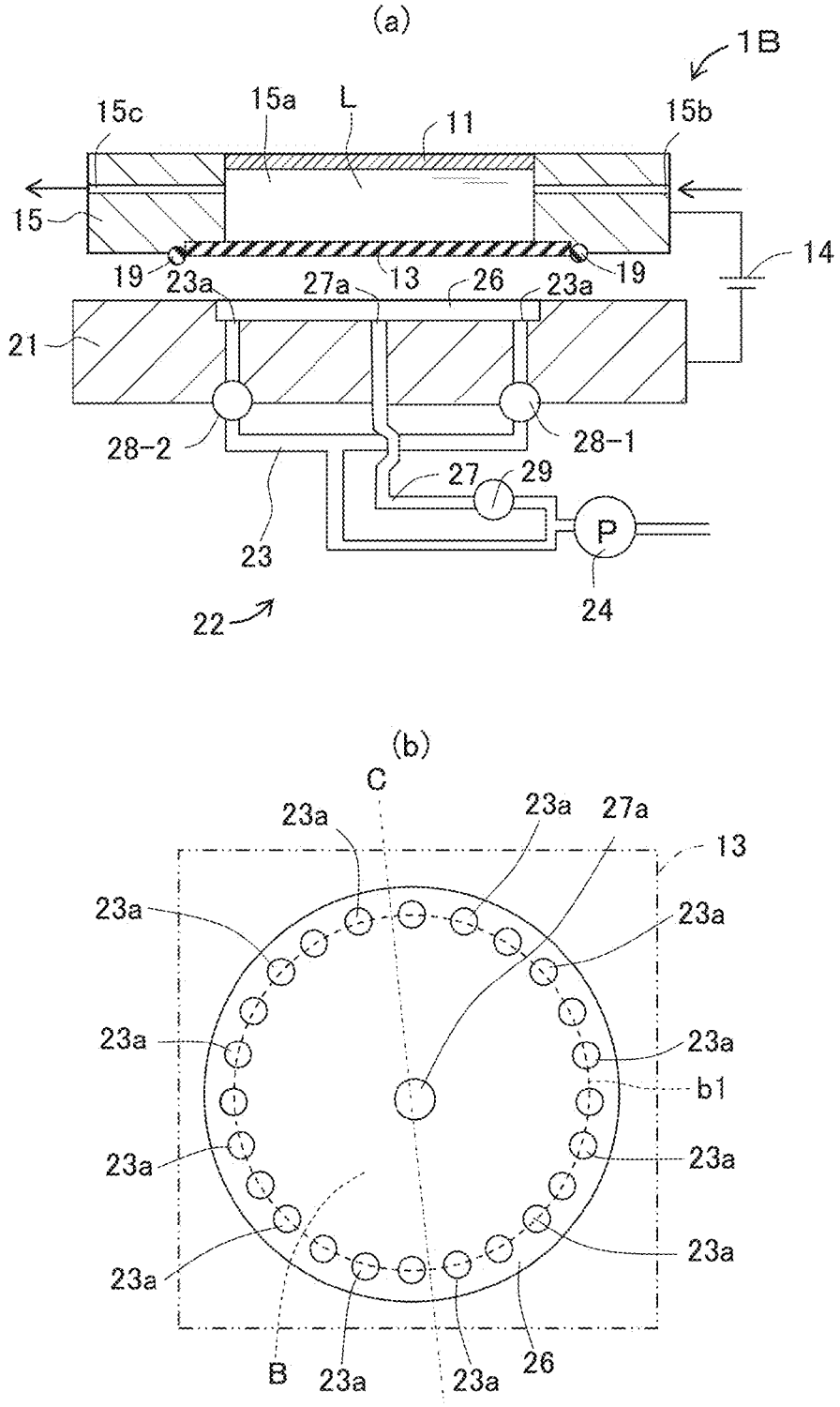
FIG. 4 is a schematic conceptual view of a film formation apparatus for forming a metal film in accordance with Embodiment 2 of the present invention, in which (a) is a schematic cross sectional view to describe the state of the film formation apparatus before film formation, and (b) is a plan view to describe the positional relationship among a solid electrolyte membrane, a membrane suction port of a suction unit, a base suction port and a base in the film formation apparatus shown in (a).

FIG. 4 is a schematic conceptual view of a film formation apparatus for forming a metal film in accordance with Embodiment 2 of the present invention, in which (a) is a schematic cross sectional view to describe the state of the film formation apparatus before film formation, and (b) is a plan view to describe the positional relationship among a solid electrolyte membrane, a membrane suction port of a suction unit, a base suction port and a base in the film formation apparatus shown in (a).

As shown in FIG. 4(*a*), a film formation apparatus 1B of a metal film according to Embodiment 2 is different from Embodiment 1 in the configuration of a suction unit 22. Therefore, the same reference numerals as those of the film formation apparatus 1A according to Embodiment 1 are assigned to the parts other than this, and their detailed descriptions are omitted.

The suction unit 22 of the film formation apparatus 1B according to the present embodiment includes a membrane suction path 23 to suck a solid electrolyte membrane 13 so that the solid electrolyte membrane 13 is brought into intimate contact with the surface of a base B placed on a mounting base 21 during film formation of a metal film F, and a base suction path 27 to suck the base B placed on the mounting base 21 to the mounting base 21.

One end of the membrane suction path 23 is connected to a suction pump 24 via membrane suction port opening/closing valves (opening/closing switches) 28-1, 28-2. At the other end of the membrane suction path 23, a plurality of membrane suction ports 23*a*, 23*a* . . . are formed. In the opening state of the membrane suction port opening/closing valves 28-1, 28-2, suction from the membrane suction ports 23*a* at the membrane suction path 23 is enabled by the suction pump 24. By switching the membrane suction port opening/closing valves 28-1, 28-2 to the closing state, suction from the membrane suction ports 23*a* at the membrane suction path 23 by the suction pump 24 can be stopped. In this way, suction or not from the membrane suction ports 23*a* can be selected by opening/closing of the membrane suction port opening/closing valves 28-1, 28-2 connected to the membrane suction ports 23*a*, 23*a* . . . .

Further, in the present embodiment, a plurality of the membrane suction port opening/closing valves 28-1, 28-2 is provided so as to allow the plurality of membrane suction ports 23*a*, 23*a* . . . to suck the solid electrolyte membrane 13 at different timings. Specifically, in the present embodiment, the plurality of membrane suction ports 23*a*, 23*a* . . . is divided into two groups, and two of the membrane suction port opening/closing valves 28-1, 28-2 are provided corresponding to the two groups so that suction or not-suction from the membrane suction ports 23*a*, 23*a* . . . is selected for each group. Among the plurality of membrane suction ports 23*a*, 23*a* . . . , for the group of the membrane suction ports 23*a*, 23*a* . . . that is located on one side (specifically located on the right of the center line C of FIG. 4(*b*)), a path connecting to them is collected and then connected to the membrane suction port opening/closing valve 28-1. On the contrary, among the plurality of membrane suction ports 23*a*, 23*a* . . . , for the group of the membrane suction ports 23*a*, 23*a* . . . that is located on the other side (specifically located on the left of the center line C of FIG. 4(*b*)), a path connecting to them is collected and then connected to the membrane suction port opening/closing valve 28-2.

In the present embodiment, the plurality of membrane suction ports 23*a*, 23*a* . . . is divided into two groups, and these plurality of membrane suction ports 23*a*, 23*a* . . . in the two groups are connected to the membrane suction port opening/closing valves 28-1 and 28-2, respectively. However, if the plurality of membrane suction ports 23*a*, 23*a* . . . can suck individually, the number of the membrane suction port opening/closing valves may be three or more. In the present embodiment, although two of the membrane suction port opening/closing valves are provided as a preferable example, only one membrane suction port opening/closing valve may be provided so as to couple with all of the membrane suction ports 23*a*, 23*a* . . . if it does not affect film formation.

Similarly to Embodiment 1, as shown in FIG. 4(*b*), the plurality of membrane suction ports 23*a*, 23*a* . . . are formed at the bottom face of the storage recess 26 of the mounting base 21 at regular intervals along the periphery of the base B placed. Each membrane suction port 23*a* is formed so that, when the base B is placed in the storage recess 26 of the mounting base 21, the periphery of the base B covers the membrane suction port 23*a* partially.

Meanwhile, one end of the base suction path 27 is connected to the suction pump 24 via a base suction port opening/closing valve (opening/closing switch) 29. At the other end of the base suction path 27, a base suction port 27*a* is formed (see FIG. 4(*a*)). In the opening state of the base suction port opening/closing valve 29, suction from the base suction port 27*a* of the base suction path 27 is enabled by the suction pump 24, and by switching the opening/closing valve 29 to the closing state, suction from the base suction port 27*a* of the base suction path 27 by the suction pump 24 can be stopped. In this way, suction or not from the base suction port 27*a* can be selected by opening/closing of the base suction port opening/closing valve 29 connected to the base suction port 27*a*.

The base suction port 27*a* is a suction port to suck the base B placed on the mounting base 21 to the mounting base 21, and as shown in FIG. 4(*b*), this is formed at the center of the bottom face (surface of the mounting base 21) of the storage recess 26 of the mounting base 21. Specifically, the base suction port 27*a* is formed toward the center part of the surface of the base B opposed to the mounting base 21 (i.e., the rear face of the base) when the base B is placed on the mounting base 21 so as to be stored in the storage recess 26. That is, when the base B is placed on the mounting base 21, the base suction port 27*a* is covered and blocked with the surface of the base B.

In this way, in the present embodiment, the membrane suction path 23 and the base suction path 27 are provided with the membrane suction port opening/closing valves 28-1, 28-2 and the base suction port opening/closing valve 29, respectively, whereby suction from the plurality of membrane suction ports 23*a*, 23*a* . . . in each group can be performed by the membrane suction port opening/closing valves 28-1, 28-2 individually, and suction from the base suction port 27*a* can be performed individually by the base suction port opening/closing valve 29.

Figure 5:
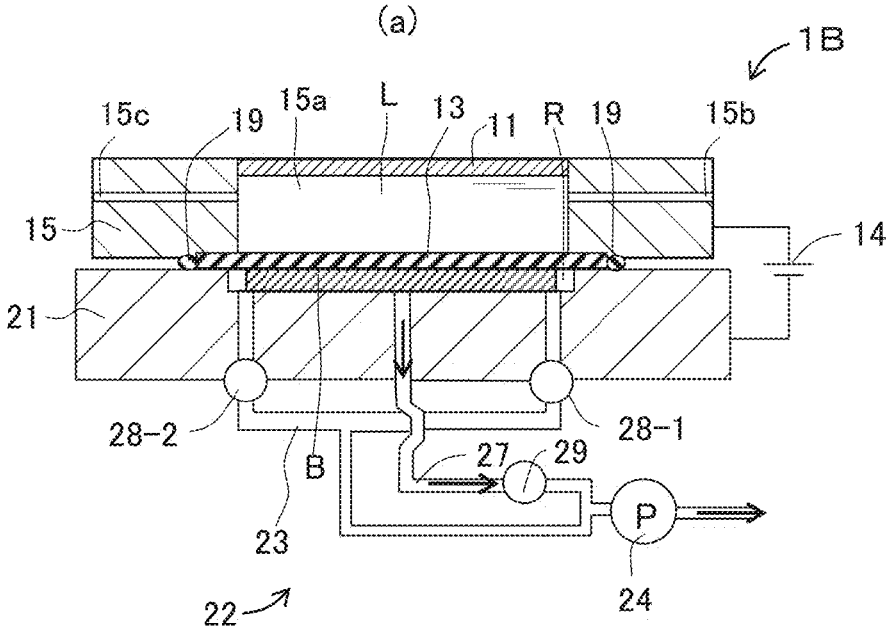
FIG. 5 describes a film formation method using the film formation apparatus of a metal film according to Embodiment 2 of the present invention, in which (a) is a schematic cross sectional view to describe the suction state of a base before film formation, and (b) is a schematic cross sectional view to describe the film formation state of the film formation apparatus.
Figure 5:
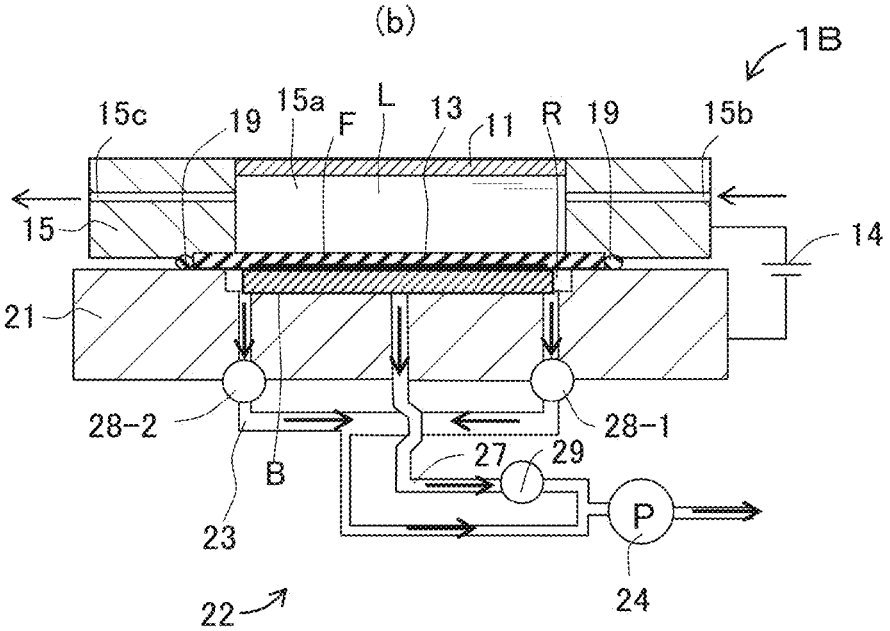

The following describes a film formation method using the film formation apparatus 1B according to Embodiment 2 with reference to FIGS. 5(*a*) and (*b*). FIG. 5 describes a film formation method using the film formation apparatus of a metal film according to Embodiment 2 of the present invention, in which (a) is a schematic cross sectional view to describe the suction state of a base before film formation, and (b) is a schematic cross sectional view to describe the film formation state of the film formation apparatus.

Firstly, similarly to Embodiment 1, the base B is placed in the storage recess 26 of the mounting base 21. In this form, as shown in FIG. 4(*b*), the plurality of membrane suction ports 23*a*, 23*a* . . . are disposed along the periphery b1 of the base B placed on the mounting base 21, and each of the membrane suction port 23*a* is blocked with the periphery b1 of the base B partially. Further, the base suction port 27*a* is covered and blocked with the surface of the base B at the center part of the base. With such an arrangement, similarly to Embodiment 1, an annular groove R is defined between the base B and the mounting base 21 so as to surround the periphery of the base B.

Next, a casing 15 is placed above the base B, and the solid electrolyte membrane 13 is brought into contact with the base B. At this stage, the solid electrolyte membrane 13 and the base B do not have to come into contact necessarily if the base B can be brought into intimate contact with the mounting base 21 through suction of the base B from the base suction port 27*a* of the suction unit 22 to the mounting base 21 as described later.

Next, while the base B is placed on the mounting base 21, the membrane suction port opening/closing valves 28-1, 28-2 are closed, the base suction port opening/closing valve 29 is opened, and the suction pump 24 is driven. Thereby, suction from the base suction port 27*a* is selected so as to allow suction of the base B to the mounting base 21 from the base suction port 27*a* at the center part of the surface of the base B facing the mounting base 21.

Subsequently, the membrane suction port opening/closing valve 28-1 and the membrane suction port opening/closing valve 28-2 are opened continuously in this order, and driving of the suction pump 24 is continued while keeping the opening state of the opening/closing valve 29. Thereby, suction from the membrane suction ports 23*a* is selected so as to allow suction of the solid electrolyte membrane 13 from the membrane suction ports 23*a* at the positions along the periphery of the base B to the base B sucked to the mounting base 21. Further, the membrane suction port opening/closing valves 28-1, 28-2 may be opened separately, whereby the timing to suck the solid electrolyte membrane 13 can be changed at different positions along the periphery of the base B for suction of the solid electrolyte membrane 13.

That is, in the present embodiment, following suction of the solid electrolyte membrane 13 from one side, the solid electrolyte membrane 13 can be sucked from the other side. Thereby, the solid electrolyte membrane 13 is not sucked at the entire periphery of the base B at the same time, whereby remaining of air between the solid electrolyte membrane 13 and the base B can be suppressed, and air on the surface of the base B can be discharged favorably. In this way, air between the mounting base 21 and the base B can be discharged from the center part of the surface of the base B facing the mounting base 21 toward the periphery thereof.

Thereby, accumulation of air between the mounting base 21 and the base B during film formation can be suppressed, so that the base B can be sucked to the mounting base 21 uniformly. As a result, the surface of the base B on which a metal film is to be formed can follow the surface of the mounting base 21, and so the solid electrolyte membrane 13 can be brought into contact with the surface on which the film is to be formed more uniformly.

According to the present embodiment, similarly to Embodiment 1, since the plurality of membrane suction ports 23*a* are arranged along the periphery of the base B, and a part of each membrane suction port 23*a* that is not covered with the periphery of the base B becomes adjacent to the periphery b1 of the base B, whereby the film formation region of the base B as a whole can be pressed more uniformly. Thereby, the solid electrolyte membrane 13 can follow the surface of the base B (film formation region) uniformly. As a result, the surface of the base B on which a metal film F is to be formed can be more flattened so as to follow the surface of the mounting base 21, and the solid electrolyte membrane 13 can be brought into contact with this surface more uniformly.

Note here that although the present embodiment is configured so that suction from the membrane suction ports 23*a* is performed while keeping suction from the base suction port 27*a*, if air between the mounting base 21 and the base B can be discharged, suction from the base suction port 27*a* may be stopped and then suction from the membrane suction ports 23*a* may be performed.

While keeping the suction state as stated above, voltage is applied to the anode 11 and the base B serving as a cathode using the power supply unit 14 similarly to Embodiment 1 so as to deposit metal on the surface of the base B from metal ions included inside of the solid electrolyte membrane 13, whereby a metal film F is formed on the surface of the base B.

In this way, air between the mounting base 21 and the base B is discharged, whereby the solid electrolyte membrane 13 can follow the base B more uniformly, and non-uniform pressure generated with the anode 11 and resulting from the surface state of the anode 11 can be eliminated or can be reduced. Thereby, a homogeneous metal film F of a uniform thickness can be formed stably, while being less affected by the surface state of the anode 11.

EXAMPLES

The following describes the present invention, by way of the following Examples.

Example 1

As a base on a surface of which a film is to be formed, a pure aluminum base (50 mm×50 mm×1 mm in thickness) was prepared, on the surface of which a nickel plating film was formed, and on a surface of the nickel plating film, a gold plating film was formed. Then, this was washed with flowing pure water.

Next, using the film formation apparatus shown in FIG. 1(*a*), a nickel film was formed as a metal film on the surface of this base. For the metal solution, 1.0 mol/L nickel sulfate aqueous solution and 0.5 mol/L of acetic acid-sodium acetate buffer solution were used, for the anode, a Pt plate (produced by The Nilaco Corporation) was used, for the solid electrolyte membrane, Nafion N212 (produced by DuPont) of 50 μm in thickness was used. For the test conditions, the suction pump was driven to suck the solid electrolyte membrane by the suction unit to the side of the base so as to bring the solid electrolyte membrane into intimate contact with the base, and in this state, the nickel film was formed with the current density of 5 mA/cm$^2$, the flow rate of metal solution that was 10 ml/min. and for 10 minutes as the film formation duration.

Comparative Example 1

Figure 6:
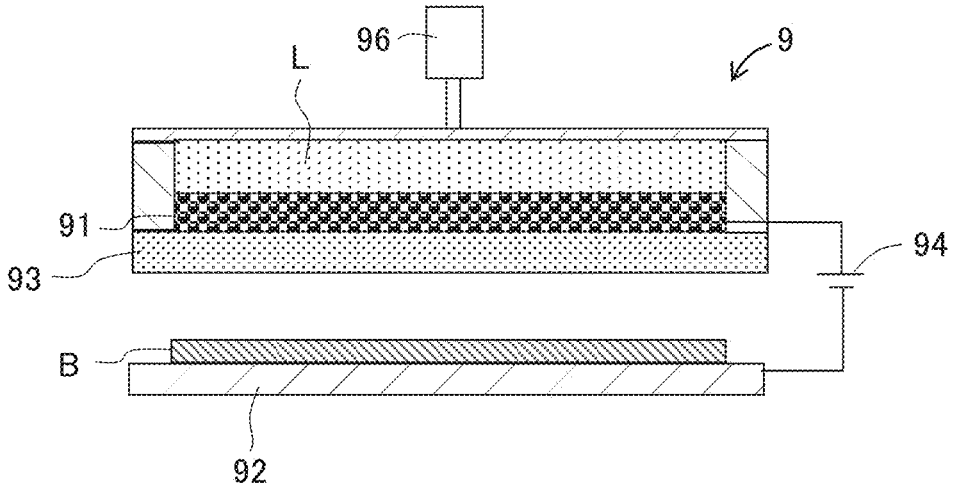
FIG. 6 is a schematic view to describe a conventional film formation apparatus, in which (a) is a schematic conceptual view of a film formation apparatus, and (b) is a schematic conceptual view to describe film formation by the film formation apparatus.
Figure 6:
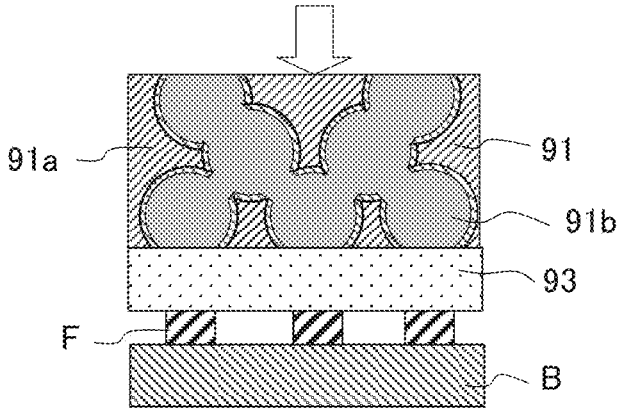

The same base as that of Example 1 was prepared, and a nickel film was formed on the surface of the base using the film formation apparatus shown in FIG. 6(*a*) and under the same film formation conditions as those of Example 1. This Comparative Example was different from Example 1 in that a porous body (produced by Mitsubishi Materials Corporation) made of foamed titanium coated with platinum was used for the anode, and the nickel film was formed while pressing the solid electrolyte membrane to the base with the anode at the pressure of 0.3 MPa during film formation.

<Evaluation Method>

The coverage factor of the nickel films on the surface and their pinholes according to Example 1 and Comparative Example 1 were evaluated. Table 1 shows the result.

TABLE 1

| | Coverage factor of nickel film | Pinholes generated |
|---|---|---|
| Ex. 1 | 100% | No |
| Comp. Ex. 1 | 90% | Yes |

(Result 1 and Consideration 1)

Figure 7:
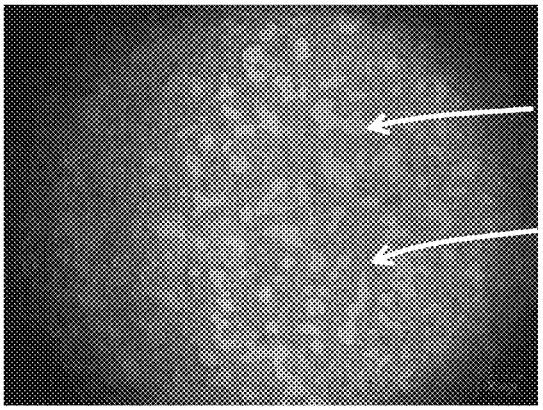
In FIG. 7, (a) is a photo of a metal film formed by the film formation apparatus shown in FIG. 6, and (b) is a cross sectional view of the metal film shown in (a)
Figure 7:
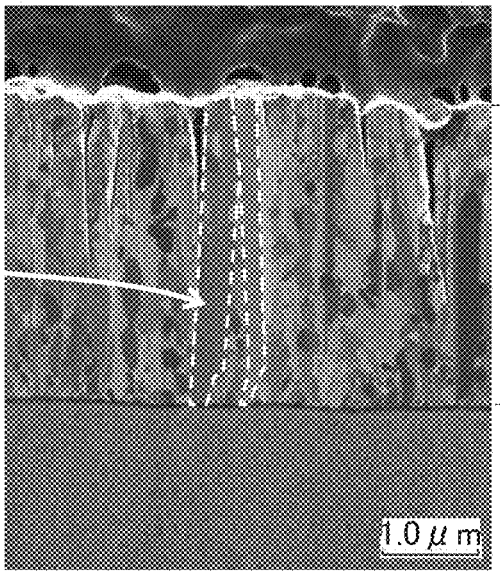

Table 1 shows that, in Example 1, the coverage factor of nickel film was higher than that of Comparative Example 1, and no pinholes occurred. The nickel film according to Comparative Example generated unevenness shown in FIG. 7(*a*) as stated above.

Such a result shows that, in the case of Example 1, the solid electrolyte membrane was sucked by the suction unit, and the surface of the base was pressed by the thus sucked solid electrolyte membrane, whereby a nickel film formed was less affected from the surface state of the anode.

On the contrary, in the case of Comparative Example 1, the anode was a porous body, and a nickel film was formed while pressing the solid electrolyte membrane to the surface of the base with this porous body, and therefore presumably the surface state of the anode affected the nickel film. It is considered that, if the suction unit is provided in Comparative Example 1 and the solid electrolyte membrane is sucked by the suction unit to reduce pressure to the solid electrolyte membrane from the anode, then the coverage factor of the nickel film will be increased and pinholes can be suppressed as in Example 1.

Example 2

The same base as that of Example 1 was prepared, and a metal film (copper film) was formed on the surface of the base using the film formation apparatus shown in FIG. 4(*a*). This Example was different from Example 1 in that 1.0 mol/L of copper sulfate aqueous solution was used for the metal solution (electrolyte), and firstly the base was sucked from the base suction port as shown in FIG. 5(*a*), and while keeping this suction state, the solid electrolyte membrane was sucked from the membrane suction ports as shown in FIG. 5(*b*), and in this state, the copper film was formed on the base. The current density was 5 mA/cm$^2$, the flow rate of metal solution was 15 ml/min., and the film formation duration was 10 minutes to form the copper film.

Example 3

The same base as that of Example 2 was prepared, and a metal film (nickel film) was formed on the surface of the base using the film formation apparatus shown in FIG. 4(*a*) under the same film formation conditions as those of Example 2. This Example was different from Example 2 in that 1.0 mol/L of nickel sulfate aqueous solution and 0.5 mol/L of acetic acid-sodium acetate buffer solution were used for the metal solution (electrolyte) to form the nickel film.

Comparative Example 2

The same base as that of Example 2 was prepared, and a copper film was formed on the surface of the base using the film formation apparatus shown in FIG. 6(*a*). This Comparative Example was different from Example 2 in that a porous body (produced by Mitsubishi Materials Corporation) made of foamed titanium coated with platinum was used for the anode, and the copper film was formed while pressing the solid electrolyte membrane to the base with the anode at the pressure of 0.3 MPa during film formation.

<Evaluation Method>

The coverage factor of the metal films on the surface and their pinholes according to Examples 2, 3 and Comparative Example 2 were evaluated. Table 2 shows the result.

TABLE 2

| | Metal film | Coverage factor of metal film | Pinholes generated |
|---|---|---|---|
| Ex. 2 | Copper film | 100% | No |
| Ex. 3 | Nickel film | 100% | No |
| Comp. Ex. 2 | Copper film | 95% | Yes |

(Result 2 and Consideration 2)

Table 2 shows that, in Examples 2, 3, the coverage factor of metal films was higher than that of Comparative Example 2, and no pinholes occurred. The metal film according to Comparative Example 2 generated unevenness shown in FIG. 7(*a*) as stated above, similarly to Comparative Example 1.

Such a result shows that, in the case of Examples 2, 3, following suction of the base by the suction unit, the solid electrolyte membrane was sucked, and the surface of the base was pressed by the thus sucked solid electrolyte membrane, whereby a nickel film formed was less affected from the surface state of the anode. On the contrary, in the case of Comparative Example 2, the anode was a porous body, and a metal film was formed while pressing the solid electrolyte membrane to the surface of the base with this porous body, and therefore presumably the surface state of the anode affected the metal film.

That is a detailed description of the embodiments of the present invention. However, the present invention is not limited to the above-stated embodiments, and the design may be modified variously without departing from the spirits of the present invention defined in the attached claims.

In the present embodiment, a base on which a metal film is to be formed has a flat surface, and the shape of the base is not limited to this. For instance, a plurality of convexes may be formed at the surface of the base, and when a film is formed on the surface of these convexes as well, the solid electrolyte membrane is sucked from the side of the base during film formation, whereby the solid electrolyte membrane can be pressed so as to follow the surface of the base.

In Embodiment 2, opening/closing of the membrane suction port opening/closing valves 28-1, 28-2 and the base suction port opening/closing valve 29 is not performed using a controller, and for example, such membrane suction port opening/closing valves 28-1, 28-2 and base suction port opening/closing valve 29 may include electromagnetic valves, and their opening/closing may be controlled by a controller. That is, a metal film may be formed while the membrane suction port opening/closing valves 28-1, 28-2 and the base suction port opening/closing valve 29 are controlled by the controller so that the base suction port opening/closing valve 29 is opened by the controller to suck from the base suction port, and thereafter the membrane suction port opening/closing valves 28-1, 28-2 are successively opened so as to suck from the membrane suction ports.

Although the film formation apparatus 1B according to Embodiment 2 is provided with the base suction port opening/closing valve 29, this base suction port opening/closing valve 29 may be omitted, and the solid electrolyte membrane 13 may be sucked at different positions along the periphery of the base B individually using the membrane suction port opening/closing valves 28-1, 28-2.

REFERENCE SIGNS LIST

1A, 1B: Film formation apparatus
11: Anode
13: Solid electrolyte membrane
14: Power supply unit
15: Casing
15*a*: Solution containing part
15*b*: Supply port
15*c*: Discharge port
19: O-ring
21: Mounting base
22: Suction unit
23: Membrane suction path
23*a*: Membrane suction port
24: Suction pump
27: Base suction path
27*a*: Base suction port
28-1, 28-2: Membrane suction port opening/closing valve
29: Base suction port opening/closing valve
26: Storage recess
B: Base (cathode)
b1: Periphery
F: Metal film
L: Metal solution
R: Groove

The invention claimed is:

1. A film formation apparatus of a metal film comprising: an anode; a solid electrolyte membrane disposed between the anode and a base serving as a cathode; and a power supply unit to apply voltage between the anode and the base, the film formation apparatus being configured so that, when the solid electrolyte membrane is brought into contact with a surface of the base, and voltage is applied between the anode and the base, metal is deposited on the surface of the base from metal ions included inside of the solid electrolyte membrane, so that the metal film made of the metal is formed, wherein the film formation apparatus comprises: a mounting base on which the base is to be placed, and a suction unit to suck the solid electrolyte membrane from a side of the base so that the solid electrolyte membrane is brought into intimate contact with the surface of the base placed on the mounting base during formation of the metal film.

2. The film formation apparatus of a metal film according to claim 1, wherein a solution containing part is defined between the anode and the solid electrolyte membrane so as to store solution including the metal ions so that the solution including the metal ions comes into contact with the anode and the solid electrolyte membrane.

3. The film formation apparatus of a metal film according to claim 2, further comprising a circulation mechanism in the solution containing part to circulate the solution including the metal ions.

4. The film formation apparatus of a metal film according to claim 1, wherein the suction unit includes a plurality of membrane suction ports at a surface of the mounting base so as to suck the solid electrolyte membrane, and the plurality of membrane suction ports is along periphery of the base placed on the mounting base.

5. The film formation apparatus of a metal film according to claim 4, wherein the membrane suction ports are formed so that each membrane suction port is covered with the periphery of the base partially when the base is placed on the mounting base.

6. The film formation apparatus of a metal film according to claim 4 wherein the suction unit includes a base suction port at the surface of the mounting base to suck the base placed on the mounting base toward the mounting base, the base suction port is formed toward a center part of a surface of the base opposed to the mounting base when the base is placed on the mounting base, and the suction unit further includes a membrane suction port opening/closing valve connected to the membrane suction ports so as to allow selection between suction and not-suction from the membrane suction ports, and a base suction port opening/closing valve connected to the base suction port so as to allow selection between suction and not-suction from the base suction port.

7. The film formation apparatus of a metal film according to claim 6, wherein a plurality of the membrane suction port opening/closing valves are provided so as to allow the plurality of membrane suction ports to suck the solid electrolyte membrane at different timings.

8. The film formation apparatus of a metal film according to claim 1, wherein the mounting base includes a storage recess to store the base when the metal film is formed on a surface of the base.

9. A film formation method of a metal film comprising: disposing a solid electrolyte membrane between an anode and a base serving as a cathode; bringing the solid electrolyte membrane into contact with the base and applying voltage between the anode and the base, so as to deposit metal on a surface of the base from metal ions included inside of the solid electrolyte membrane, so that the metal film made of the metal is formed on the surface of the base, wherein when the metal film is formed, the solid electrolyte membrane is sucked from a side of the base so that the solid electrolyte membrane is brought into intimate contact with the surface of the base.

10. The film formation method of a metal film according to claim 9, wherein the metal film is formed while storing solution including the metal ions between the anode and the solid electrolyte membrane so that the solution including the metal ions comes into contact with the anode and the solid electrolyte membrane.

11. The film formation method of a metal film according to claim 9, wherein the metal film is formed while circulating the solution including the metal ions stored between the anode and the solid electrolyte membrane.

12. The film formation method of a metal film according to according to claim 9, wherein the solid electrolyte membrane is sucked from a position along periphery of the base.

13. The film formation method of a metal film according to according to claim 12, wherein the metal film is formed while placing the base on a mounting base, and along with suction of the solid electrolyte membrane, the periphery of the base is sucked toward the mounting base.

14. The film formation method of a metal film according to according to claim 12, wherein the base placed on the mounting base is sucked toward the mounting base at a center part of a surface of the base opposed to the mounting base, and the solid electrolyte membrane is sucked to the base that is sucked to the mounting base.

15. The film formation method of a metal film according to according to claim 14, wherein the solid electrolyte membrane is sucked at different positions along the periphery of the base while changing timings to suck the solid electrolyte membrane.

16. The film formation method of a metal film according to according to claim 13, wherein the mounting base includes a storage recess to store the base, and the metal film is formed on a surface of the base that is stored in the storage recess.

* * * * *